United States Patent [19]

Seyffert et al.

[11] 4,389,296

[45] Jun. 21, 1983

[54] EDGE CONTACTING PLATING ELECTRODE

[75] Inventors: Michael Seyffert, Santa Cruz; Steven W. Taatjes, San Jose, both of Calif.

[73] Assignee: National Semiconductor Corporation, Santa Clara, Calif.

[21] Appl. No.: 360,743

[22] Filed: Mar. 22, 1982

[51] Int. Cl.[3] ..... C25D 17/00

[52] U.S. Cl. ..... 204/206

[58] Field of Search ..... 204/206, 207, 208, 209, 204/210, 211

[56] References Cited

U.S. PATENT DOCUMENTS

| | | | |
|---|---|---|---|
| 1,692,757 | 11/1928 | Nixon | 204/206 |
| 2,370,420 | 2/1945 | Rayburn | 204/209 |
| 3,964,989 | 6/1976 | Ackerly | 204/206 |

*Primary Examiner*—John F. Niebling

*Attorney, Agent, or Firm*—Neil B. Schulte; Paul J. Winters; Gail W. Woodward

[57] ABSTRACT

A contact for making electrical connections to a moving strip of metal, so as to permit plating the strip, in which grooved members engage just the edges of the strip, thus avoiding scratches on the face of the strip.

7 Claims, 3 Drawing Figures

EDGE CONTACTING PLATING ELECTRODE

BACKGROUND OF THE INVENTION

High quality plating of precious metals onto strips of metal or webs, such as done to produce lead frames for mounting semiconductor chips, requires machines that transport the delicate strip carefully. Mechanical damage makes it necessary to scrap the product along with the precious metal thereon. The prior art generally restricts precious metal plating to selected small areas on the web to conserve precious metal. Hence, the web can be handled by apparatus that contacts the web in non-critical areas.

One important part of the machine that must made good contact to the web is the electrodes which transfer the electrical current to the web during the plating operation. Prior art electrodes generally come into contact with the face of the strip, where a large area is available, so as to insure good electrical connections between the stationary electrodes and the moving web. However, in some products, the entire face of the web is plated with metal and the possibility exists that the electrodes will scratch up the plated surface. The present invention avoids this problem.

SUMMARY OF THE INVENTION

Briefly, this invention involves apparatus that can achieve reliable and adequate electrical connections to the very edge of a moving metal strip or web. Spring loaded contacts enclose the web from both sides. Grooves in the contacts guide the web into a position such that intimate electrical contact is assured despite the comparatively small area of contact compared to prior art approaches.

DESCRIPTION OF THE PREFERRED EMBODIMENT

Figure 1:
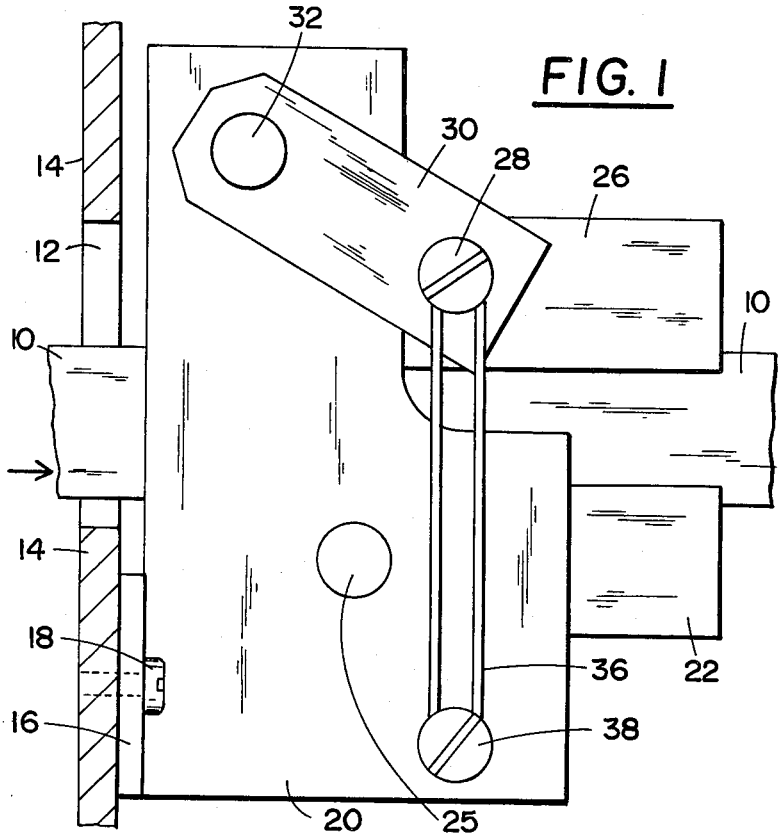
FIG. 1 is an elevational view of a preferred embodiment of the invention mounted to the side of a plating or rinse tank shown in fragmentary section only.
Figure 2:
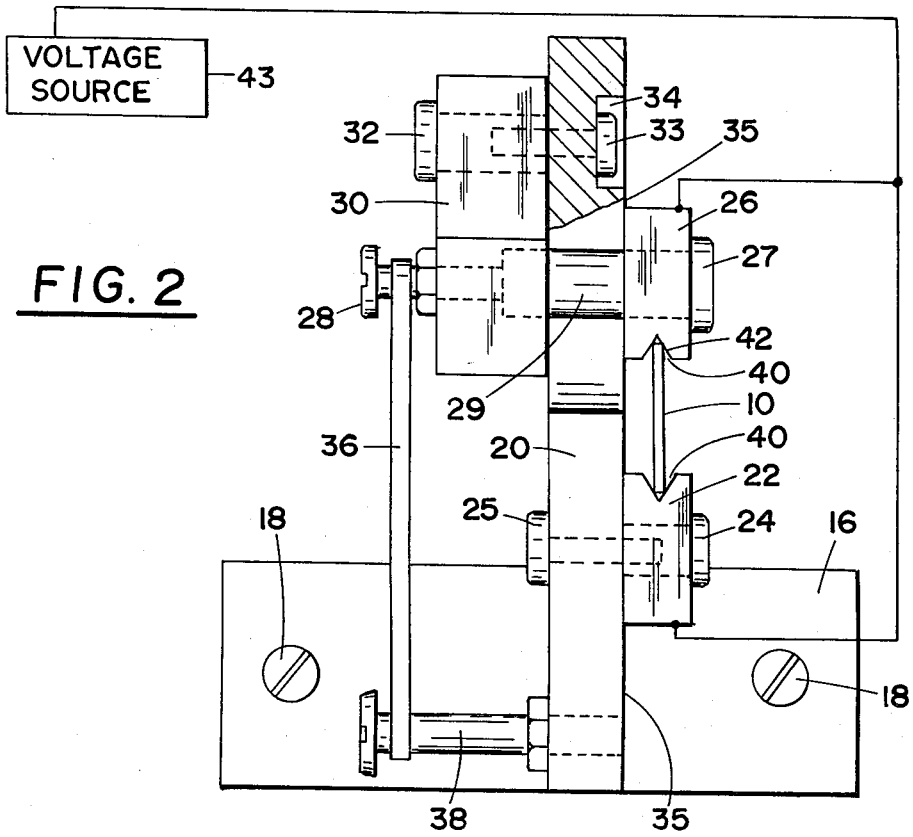
FIG. 2 is an elevational side view of the right side of the embodiment shown in FIG. 1.

Referring simultaneously to FIGS. 1 and 2, a portion of a web 10 to be plated is shown passing through the electrode contacts of the present invention. Web 10 emerges through a hole 12 in the wall 14 of a plating or rinse tank. It may be desirable to provide a rinse tank just before the electrode to avoid inadvertent plating on the electrode itself due to residual plating solution on web 10. The electrode is mounted on wall 14 by a flange 16 and screws 18. Flange 16 holds a support structure, or bracket, 20 in a position just adjacent and proximate the processing path of web 10. The lower edge of web 10 is guided, supported, and slidably contacted by a first contact 22 that is pivoted on support bracket 20 by suitable fasteners 24 and 25. Since contact 22 may pivot, it can easily track the edge of web 10 and thus avoid mechanical lock ups with the moving web.

A second pivotable floating contact 26 engages the top edge of web 10 in a similar fashion. Contact 26 is pivoted on a movable member 30 with suitable fasteners 27 and 28 and located laterally by a spacer 29. Member 30 is, in turn, pivoted on bracket 20 by fasteners 32 and 33, screw 33 being recessed in a clearance hole 34 to provide clearance to contact 26. As member 30 moves up and down, about pivot pin 32, it allows contact 26 to track webs of varying width. Both contacts 22 and 26 are located laterally, and aligned with each other, by their position along the flat face 35 of bracket 20.

A simple elastic rubber strap 36 extends from fastener 28 to a stud 38 so as to springably urge the contacts 22 and 26 toward each other and into sliding contact with the edge of web 10. In some cases gravity may supply sufficient tracking and contact force.

Each contact incorporates, for its entire length, a groove 40. The sides 42 of grooves 40 slant inward, toward each other, as they extend deeper into the grooves. Thus, when strap 36 pulls the contacts together, web 10 is urged toward the deep center part of the groove and both corners of web 12 are caused to slide in contact with groove 40. Contact 22 also supplies vertical support, while the contacts together supply lateral support to the moving web.

A voltage source 43 connects to contact 22 and 26 directly, so as to provide optimum electrical connection, and in the position shown to avoid mechanical interference. The floating and pivoting of the contacts, the shape of the grooves, the length of the contacts, and the spring 36 all contribute and cooperate to insure adequate current flow to web 10 while still avoiding contact with the fragile face of web 10.

Figure 3:
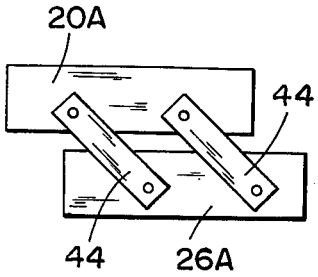
FIG. 3 shows schematically an alternate embodiment of the invention using a different movement linkage.

Another possible variation, shown in FIG. 3, carries the upper contact 26A on a pair of parallel swing arms 44 that pivot on a support bracket 20A. With this arrangement, longitudinal stability of the floating contact is enhanced. Further variations that do not depart from the spirit and scope of the invention will occur to those skilled in the art.

What is claimed is:

1. In apparatus to electroplate material onto a movable web of conductive material, an electrode adapted to provide electrical contact with the web comprising in combination:

support bracket means adapted to be mountable proximate the path of said movable web;

a first contact mounted on said support bracket means, having a groove operable to accept one edge of the web for sliding contact therein;

a second contact pivotally mounted on said support bracket means, having a groove operable to accept the other edge of the web for sliding contact therein, said grooves being generally straight and extending along the edge of the web for a length sufficient to provide smooth sliding contact with said web and generous contact area, and having V-shaped sides that slant towards each other, as said sides extend deeper into the grooves, so as to center the web in the groove under the action of said urging means and enhance contact with the corners of the web; and means urging said first and second contacts toward each other and into sliding contact with the edges of said web.

2. The electrode of claim 1 in which said second contact is pivotally mounted by being pivotable on one end of a movable member, said movable member mounted for movement on said support bracket means.

3. The electrode of claim 2 in which said urging means comprises an elastic tension strap extending between said movable member and said support bracket means.

4. The electrode of claim 1 in which said urging means comprises an elastic tension strap extending between said second contact and said support bracket means.

5. The electrode of claim 1 in which said second contact is pivoted on said support bracket means by a pair of parallel swing arms, said arms pivoted on said support bracket means at one end and pivoted on said second contact at the other end.

6. The electrode of claim 2 in which said urging means comprises an elastic tension strap extending between said movable member and said support bracket means.

7. The electrode of claim 5 in which said urging means comprises an elastic tension strap extending between said second contact and said support bracket means.

* * * * *